US006179458B1

(12) United States Patent
Albers et al.

(10) Patent No.: US 6,179,458 B1
(45) Date of Patent: Jan. 30, 2001

(54) FORMING A SOLUTION OF FLUIDS HAVING LOW MISCIBILITY AND LARGE-SCALE DIFFERENCES IN VISCOSITY

(75) Inventors: Robert E Albers, Wilmington, DE (US); Arthur William Etchells, Philadelphia; Joseph Daniel Gutmann, Jr., Lincoln University, both of PA (US); Edgar W. Slocum, Wilmington, DE (US); Ashok H. Shah, Chesterfield, VA (US)

(73) Assignee: E. I. du Pont de Nemours and Company, Wilmington, DE (US)

( * ) Notice: Under 35 U.S.C. 154(b), the term of this patent shall be extended for 0 days.

(21) Appl. No.: 08/960,655

(22) Filed: Oct. 30, 1997

Related U.S. Application Data

(60) Provisional application No. 60/029,539, filed on Nov. 1, 1996.

(51) Int. Cl.[7] ..... B01F 7/02; B01F 15/02

(52) U.S. Cl. ..... 366/76.1; 366/82; 366/150.1; 366/320; 366/325.7

(58) Field of Search ..... 366/315, 320, 366/325, 325.4, 325.5, 325.7, 325.8, 325.9, 325.91, 327.4, 329.1, 144, 147, 336, 150.1, 177.1, 181.4, 97, 79, 82, 98, 80, 76.1, 99, 81; 422/137, 135

(56) References Cited

U.S. PATENT DOCUMENTS

| | | | | |
|---|---|---|---|---|
| 1,500,061 | * | 7/1924 | Dimm | 366/320 |
| 3,081,519 | | 3/1963 | Blades et al. . | |
| 3,160,688 | | 12/1964 | Aykanian et al. . | |
| 3,169,899 | | 2/1965 | Steuber . | |
| 3,199,147 | | 8/1965 | Aykanian et al. . | |
| 3,227,794 | | 1/1966 | Anderson et al. . | |
| 3,279,894 | * | 10/1966 | Tate et al. | 422/137 |
| 3,469,948 | * | 9/1969 | Anderson et al. | 366/325.8 |
| 3,484,899 | | 12/1969 | Smith . | |
| 3,497,918 | | 3/1970 | Pollack et al. . | |
| 3,591,344 | * | 7/1971 | Schnock et al. | 366/325.8 |
| 3,709,664 | | 1/1973 | Krekeler et al. . | |
| 3,753,661 | * | 8/1973 | Simons | 422/137 |
| 3,860,369 | | 1/1975 | Brethauer et al. . | |
| 3,889,931 | | 6/1975 | Adams . | |
| 3,941,535 | | 3/1976 | Street | 425/208 |
| 4,054,625 | | 10/1977 | Kozlowski et al. . | |
| 4,066,246 | | 1/1978 | Korstvedt | 366/293 |
| 4,352,650 | | 10/1982 | Marshall | 425/174.8 |
| 4,460,278 | * | 7/1984 | Matsubara et al. | 366/320 |
| 4,554,207 | | 11/1985 | Lee | 428/288 |
| 4,610,068 | * | 9/1986 | Schultz | 366/320 |
| 4,627,735 | * | 12/1986 | Rose et al. | 366/320 |
| 4,906,519 | * | 3/1990 | Stanko et al. | 428/224 |
| 5,028,141 | | 7/1991 | Stiegelmann | 366/245 |
| 5,123,983 | | 6/1992 | Marshall | 156/167 |
| 5,178,641 | | 1/1993 | Taniguchi | 366/332 |
| 5,189,474 | * | 2/1993 | Miya et al. | 366/320 |
| 5,192,468 | | 3/1993 | Coates et al. | 264/13 |
| 5,215,764 | | 6/1993 | Davis et al. | 425/208 |
| 5,816,700 | * | 10/1998 | Starke, Sr. et al. | 425/209 |

FOREIGN PATENT DOCUMENTS

| | | |
|---|---|---|
| 0 285 670 A1 | 10/1988 | (EP) . |
| 0 351 693 | 7/1989 | (EP) . |
| 0 482 882 | 4/1992 | (EP) . |
| 0 709 664 | 5/1996 | (EP) . |
| 0 664 151 A1 | 7/1998 | (EP) . |

* cited by examiner

*Primary Examiner*—Tony G. Soohoo

(57) ABSTRACT

This invention relates to mixing two substantially immiscible fluids having substantial viscosity differences into a single phase solution. The invention particular includes a mixer comprising a specially designed conveyor flights to provide shear mixing without differential conveying of the fluids or causing excessive back pressure or pressure drop on the solution.

21 Claims, 7 Drawing Sheets

FORMING A SOLUTION OF FLUIDS HAVING LOW MISCIBILITY AND LARGE-SCALE DIFFERENCES IN VISCOSITY

This application claims benefit of priority from Provisional Application Ser. No. 60/029,539, filed Nov. 1, 1996.

FIELD OF THE INVENTION

This invention relates to a process and system for mixing fluids and particularly to mixing fluids that are not readily dissolved together and fluids that have very substantial differences in their relative viscosities.

BACKGROUND OF THE INVENTION many years, E.I. du Pont de Nemours and Company (DuPont) has been making TYVEK® spunbonded olefin. Commercial end uses for TYVEK® spunbonded olefin sheets have been developed for mailing envelopes, housewrap, apparel, medical packaging and many other uses. The process for making the spunbonded olefin has been the subject of numerous patents including U.S. Pat. No. 3,081,519 to Blades et al., U.S. Pat. No. 3,169,899 to Steuber, U.S. Pat. No. 3,227,794 to Anderson et al., U.S. Pat. No. 3,484,899 to Smith, U.S. Pat. No. 3,497,918 to Pollock et al., U.S. Pat. No. 3,860,369 to Brethauer et al., U.S. 4,352,650 to Marshall, U.S. Pat. No. 4,554,207 to Lee, and U.S. Pat. No. 5,123,983 to Marshall. The basic steps of this process are (1) forming a solution of polyolefin polymer with Freon® 11 spin agent, and (2) flash spinning the solution in a spin cell. Freon® is a registered trademark owned by DuPont. However, Freon® 11 spin agent is a chlorofluorocarbon (CFC) and is believed to be a cause of ozone depletion. The use of most CFC materials are targeted to be eventually banned.

DuPont has sought a substitute spin agent for use in the continued manufacturing of spunbonded olefins. Unfortunately, there is not a readily available spin agent that would be a simple substitute for the Freon® 11 spin agent. Although it has been found that spunbonded olefins may be made using one of a number of different spin agents, each potential alternative spin agent gives rise to numerous production process or product quality issues. Among the alternative spin agents that have been found for making TYVEK® spunbonded olefin are certain hydrocarbons, including pentane. An important issue for hydrocarbon spin agents is their flammability whereas Freon® 11 spin agent is not at all flammable. The issues of flammability and explosivity are substantial when one considers that the spin agents will be subjected to high pressure and high temperature during the flash spinning processes. The solution provided to the spin cell is approximately eighty percent spin agent by weight so the amount of hydrocarbon that may be subjected to the high pressures and temperatures associated with flash spinning is not minimal.

The solutioning system in the process for making spunbonded olefin is the portion of the system that mixes the polymer with the spin agent to form a homogenous solution suitable for spinning into plexifilaments. The solutioning system in current use is generally illustrated in FIG. 1. As illustrated, the system comprises a very large drum 12 arranged to receive measured amounts of polyethylene pellets and spin agent. The polyethylene pellets are supplied from a hopper 14 and the spin agent is supplied from a tank 15. The drum 12 is sized to hold the pellets and spin agent for an extended period of time (e.g. hours) and is approximately 5000 gallons. The drum is closed and maintained at approximately room temperature and pressure. The pellets are rapidly stirred by a rotating agitator 19 to form a uniform slurry. The pellets and spin agent are drawn from the drum 12 into a pressure pump 21 which pumps the polymer slurry so as to raise the slurry pressure while directing the slurry through a heat exchanger 22 to raise the slurry temperature. The high pressure, high temperature slurry is then provided to a dissolver tank 23 where the slurry is stirred and mixed by an agitator 24 until the mixture becomes a homogeneous solution suitable for flash spinning in a spin cell, schematically indicated at 25.

With the conventional solutioning system described above, there had been concern about transient fluctuations in the ratio of spin agent to polymer which may significantly effect the quality and properties of the flash spun product. Thus, there has been considerable effort to blend the solution in the system in a manner that eliminates or substantially reduces such transient fluctuations in the solution. As such, the system provides for large amounts of the solution in both the dissolver tank 23 and the drum 12 at any given time. A plant may spin anywhere from 2000 to 10,000 pounds of polymer per hour and the solution from which this polymer is spun is ordinarily comprised of 75 to 90 percent spin agent by weight. Thus the conventional solutioning process of FIG. 1 requires that tank 23 hold very large amounts of spin agent at high pressure and temperature for extended periods of time. When the non-flammable spin agent is replaced with a highly flammable spin agent, such a large volume of flammable spin agent at high pressure and temperature would raise serious safety concerns.

Accordingly, a solutioning system for a flash spinning process is needed that reduces or avoids the safety concerns described above.

A solutioning system for mixing the polymer with a solvent to form a spin solution is also needed wherein the overall solutioning system has a reduced volume of spin agent as compared to current and conventional solutioning systems.

SUMMARY OF THE INVENTION

The above and other objects of the invention are achieved by a mixer for mixing at least two fluid materials wherein the two fluid materials have substantially different viscosities. The apparatus includes a generally cylindrical elongate tube forming an outer shell and defined by a longitudinal axis and an inner wall spaced at a generally uniform distance from the axis. A shaft is arranged along the axis with a plurality of flights attached thereto. The flights are arranged to provide substantial shear forces on the polymer and fluid mixture while generally not differentially conveying one of the two phases, which have a viscosity ratio of more than 10,000 to 1, causing transient fluctuations in the ratio of spin agent to polymer.

The objects of the present invention may also be characterized as a solutioning system for mixing a polymer and a spin agent wherein the spin agent and polymer which may be chemically compatible but are not readily miscible. The solutioning system forms a high pressure and temperature spin solution suitable for flash spinning plexifilaments and includes a heating mechanism for melting the polymer and a pressure creating device for raising the pressure of the molten polymer. The system further includes a mechanical mixer having a longitudinal generally cylindrical housing having an inner wall and a shaft mounted for rotation in the housing. The mechanical mixer also includes flights which are arranged on said shaft to provide shear forces on the polymer and spin agent within the chamber while not causing differential conveying of the material in the housing.

Another aspect of the present invention relates to a process for mixing two fluid materials which have low miscibility and a viscosity ratio of at least 10,000 to 1, wherein the process comprises adding the highly viscous fluid to a mechanical mixer, adding a portion of the low viscosity fluid, and agitating the two materials in the mixer in a first mixer section wherein the fluids are not differentially conveyed.

A further aspect of the present invention is a mixing element for a mechanical mixing apparatus suited for being rotated within a generally cylindrical housing. The mixing element includes a mounting shaft and flights extending outwardly from the mounting shaft. The mixing element provides a pressure drop as fluid passes through the cylindrical housing but wherein the pressure drop is substantially the same regardless of the speed at which the mixing element rotates with the cylindrical housing.

BRIEF DESCRIPTION OF THE DRAWINGS

The invention will be more easily understood by a detailed explanation of the invention including drawings. Accordingly, drawings which are particularly suited for explaining the invention are attached herewith; however, it should be understood that such drawings are for 25 explanation only and are not necessarily drawn to scale. The drawings are briefly described as follows.

DETAILED DESCRIPTION OF THE PREFERRED EMBODIMENT

Figure 1:
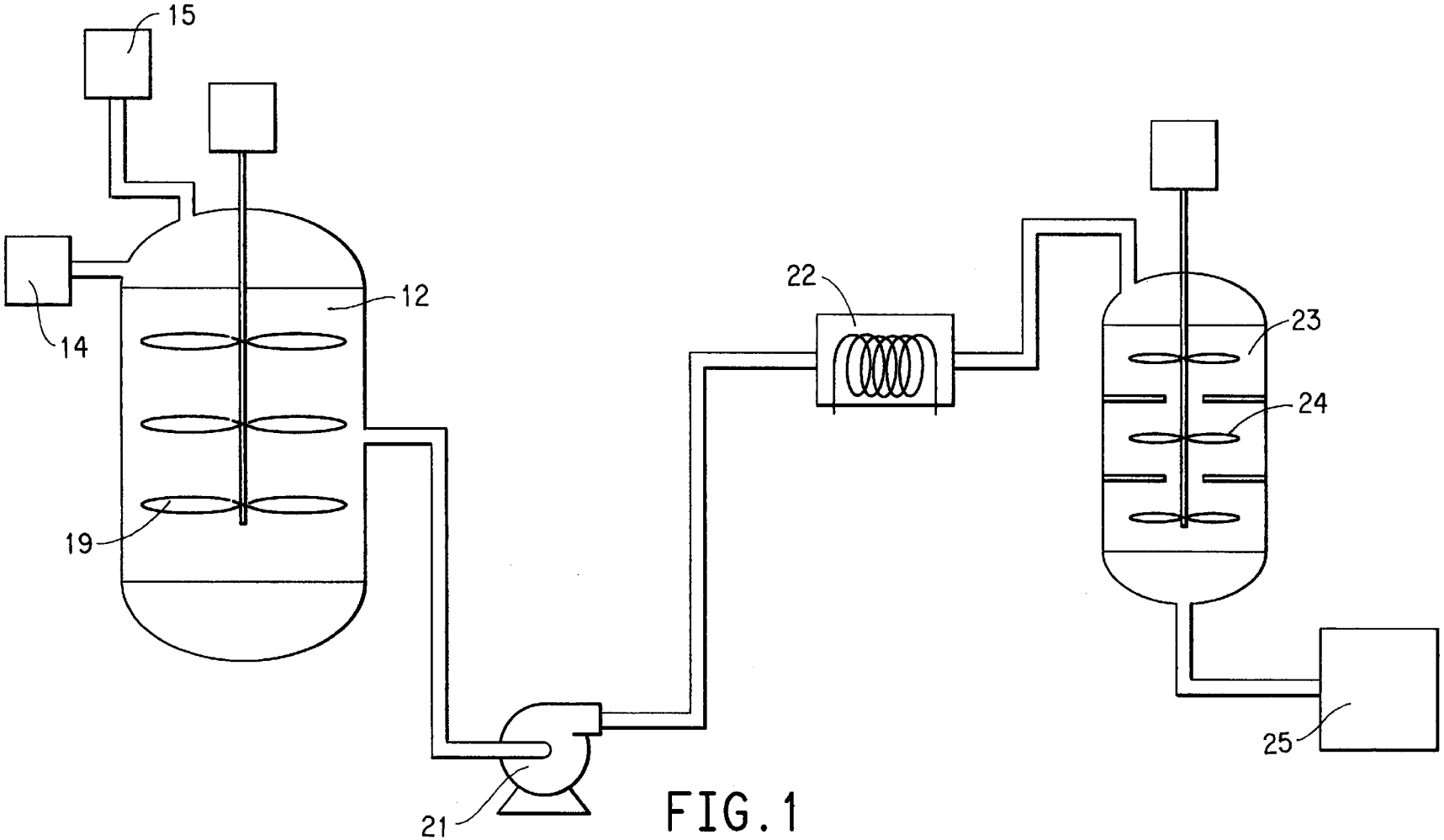
FIG. 1 (Prior Art)
FIG. 1 is a generally schematic view of a known solutioning system used for making flash spun spunbonded olefin.
Figure 2:
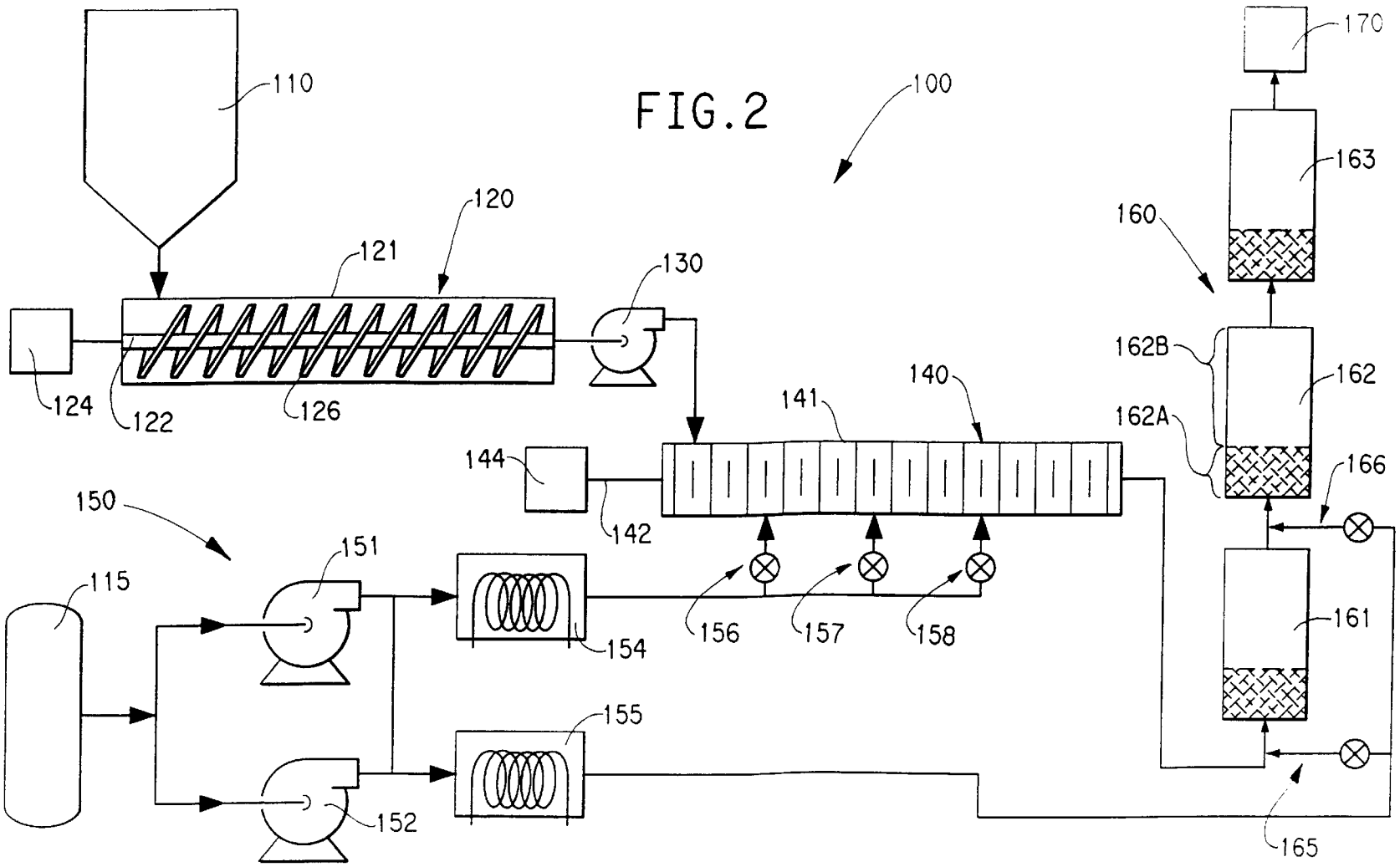
FIG. 2 is a generally schematic view of the preferred embodiment of the new solutioning system according to the present invention.

Turning now to the drawing figures, the preferred embodiment of a solutioning system, generally indicated by the number 100, is schematically illustrated in FIG. 2. The solutioning system 100 is used to create a homogenous solution of polyolefin fiber forming polymer and a suitable spin agent for flash spinning plexifilaments in a spin cell 170. The solutioning system 100 is an integrated system in that it combines a number of components and subsystems which cooperate to provide a high pressure, high temperature environment for forming a uniform solution which is suitable for flash spinning plexifilaments.

As illustrated in FIG. 2, the solution system 100 includes a hopper 110 for storage and delivery of the polyolefin pellets. The pellets are provided to one end of an extruder 120 to heat and melt the pellets. In the preferred embodiment, the extruder 120 is a conventional twin screw design including an elongate tubular pressure chamber 121 with a pair of screws 122 arranged to carry the polymer along the chamber 121 while squeezing and compressing the same. The screws 122 include helical auger-like flights 126 on a shaft which is driven by a powerful motor 124. At the end of the chamber 121, the polymer emerges as a continuous, molten mass of very thick, highly viscous fluid material.

The molten polyolefin is then directed to a gear pump 130. The gear pump 130 is of conventional design to convey a thick fluid at a range of predetermined rates. In the solutioning system 100, the gear pump 130 pushes the molten polyolefin at a predetermined rate through the remainder of solution system 100 and also provides the high pressures that are required to form the homogeneous solution. From the gear pump 130, the molten polymer is then directed into the end of a mechanical mixer 140.

The mechanical mixer 140 generally comprises a long, generally cylindrical chamber 141 with a rotatable shaft 142 extending generally along the center of the long chamber 141. A motor 144 rotates the shaft 142 which causes an array of elements attached to the shaft 142 to mix and blend a low viscosity spin agent into the polymer. The structure of the mixer 140 and the elements on the shaft 142 will be further discussed in greater detail below. It is in the mechanical mixer 140 that the spin agent and polymer are first contacted to begin forming the homogenous solution. The spin agent is stored in a tank 115 and provided through a spin agent injection system, generally indicated by the number 150 to the mechanical mixer 140. It should be noted that the spin agent is added to the polymer in several successive stations along the mechanical mixer 140 and further amounts of spin agent are provided to the polymer downstream of the mechanical mixer in static mixer section 160.

The spin agent injection system 150 provides the spin agent through positive displacement pumps 151 and 152 to provide predetermined flow rates of the spin agent that are in accordance with the rate of the gear pump 130 to produce a solution with the ratio of spin agent to polymer that is desired for flash spinning. The spin agent may be heated (or cooled) as necessary by heat exchangers 154 and 155 prior to being mixed with the molten polymer. The spin agent is directed to the polymer at several injection stations 156, 157, and 158 along the chamber 141 of the mechanical mixer 140.

At the first injection station 156, the polymer and a small amount of spin agent (relative to the amount that will constitute the final solution) are mixed together in the mechanical mixer 140 and are moved along therein by the polymer being pushed by the gear pump 130 into the mechanical mixer 140. As the polymer and spin agent move along the mechanical mixer 140, they are blended to form a homogeneous solution prior to reaching the second spin agent injection station 157. This first solution has a slightly lower viscosity than the neat molten polymer and also achieves successively lower viscosities as more spin agent is injected at the second and successive spin agent injection stations 157 and 158. The solution is discharged from the opposite end of the mechanical mixer 140 and directed to a static mixer section 160 wherein more spin agent is added to bring the solution to a final polymer to spin agent ratio for flash spinning.

The static mixer section 160 comprises one or more static mixers (also known as "motionless mixers"), which in the preferred embodiment comprises three static mixing elements 161, 162, and 163. Immediately prior to the first static mixer 161 is the first in a second series of spin agent injection stations which will be called the static mixer spin agent injection stations 165 and 166. As noted above, the ratio of spin agent to polymer increases and the viscosity of the solution decreases as the solution passes each spin agent injection station. The static mixers 161, 162 and 163 include internal structures to create a significantly tortuous path that effectively mixes the solution as it moves through the static mixer. The internal structure is preferably similar to designs commonly called "Koch Mixers SMX" which are available from Koch Industries of Wichita, Kans. A second static mixer spin agent injection station 166 may be positioned between the first and second static mixers 161 and 162 after which the solution may be subjected to two final mixing steps in static mixers 162 and 163. From the last static mixer 163 the solution is provided to the spin cell generally indicated by the number 170.

In the static mixing section 160, preferably each of the static mixers include a mixing zone and a relaxation zone. For example, the second static mixer 162, in FIG. 2, includes the mixing portion 162A wherein the solution at a particular cross sectional plane is thoroughly mixed such that solution at the edges of the flow path is mixed with fluid at the center of the flow path and vice versa. In the mixing portion 162A, all parts of solution passing through the mixer tends to flow at a single rate whether at the edge of the flow path or towards the center of the flow path. In the relaxation zone 162B, the portion of the solution in the middle of the flow path moves faster than portions of the solution near the edges of the flow path. Thus, by the time the solution enters the next static mixer 163, the particular cross sectional plane of solution entering the next mixer at any given time includes portions of the solution of polymer and spin agent that were first mixed at a number of different times. In the next static mixer 163, the solution is thoroughly mixed again across the cross sectional plane of the flow path. The effect of the series of static mixers, each with a mixing zone and relaxation zone, is to balance out slight variations in polymer/spin agent ratios that naturally occur.

The description of the solution system 100 now will focus on some of the details of the components and subsystems thereof so that they may be better understood. One of the central components of the solution system 100 is the mechanical mixer 140. The mixing of the spin agent and polymer has provided considerable challenges. First, there is a vast difference between the viscosity of polyethylene polymer (preferred embodiment) and a hydrocarbon spin agent. For example, the hydrocarbon spin agent pentane has a viscosity of approximately 0.2 centipoise (cP) while molten polyethylene has a viscosity of approximately 6,400,000 cP (1 cp equals 0.001 pascal seconds). Second, a polyolefin polymer such as polyethylene, does not readily absorb a hydrocarbon spin agent such as pentane. The spin agent only gradually diffuses into the polymer rich phase. Thus, the spin agent must be well blended into the polymer or polymer solution to hasten the formation of a homogenous solution. Thirdly, throughout the mixing process, the solution must maintain an elevated pressure and temperature suitable for flash spinning. Thus, the mechanical mixer 140 must effect mixing without creating an excessive pressure drop which will cause the solution to fall below the cloud point pressure of the solution which pressure would be unsuitable for flash spinning.

Figure 3:
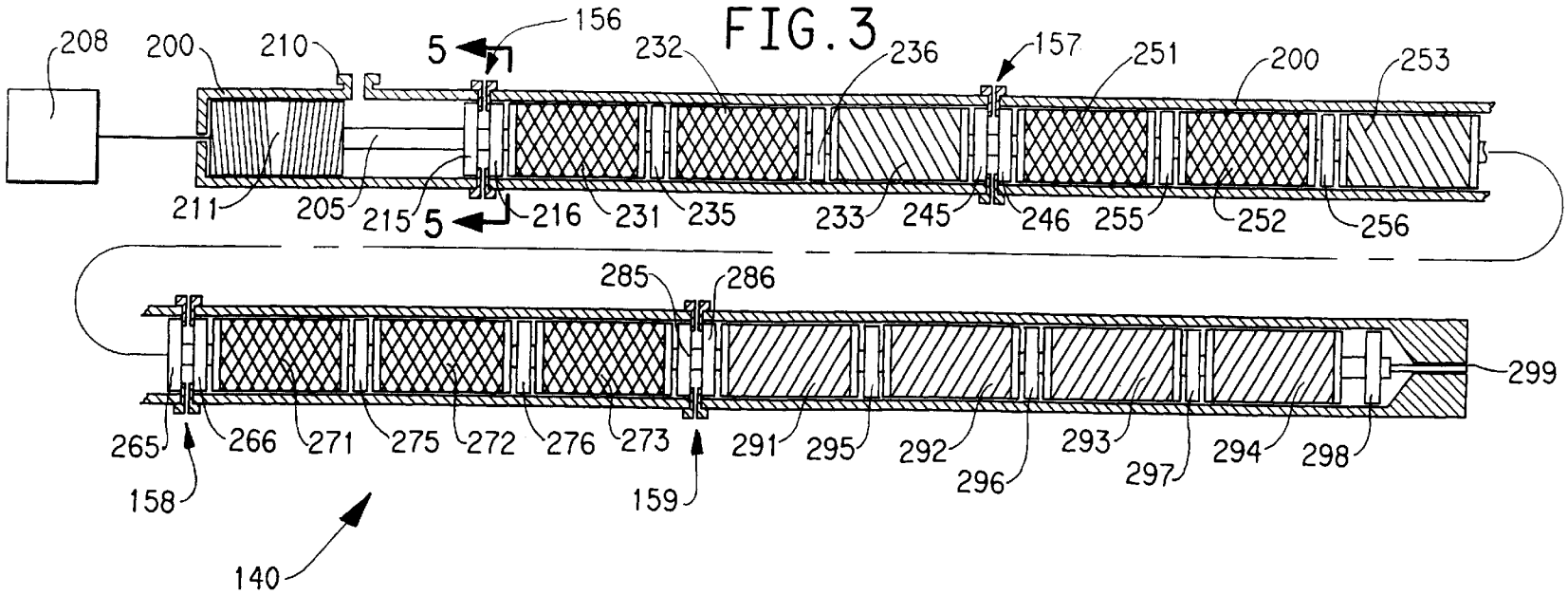
FIG. 3 is a detailed cross sectional view of a first preferred embodiment of the mechanical mixer which comprises a portion of the new solutioning system of the present invention.
Figure 4:
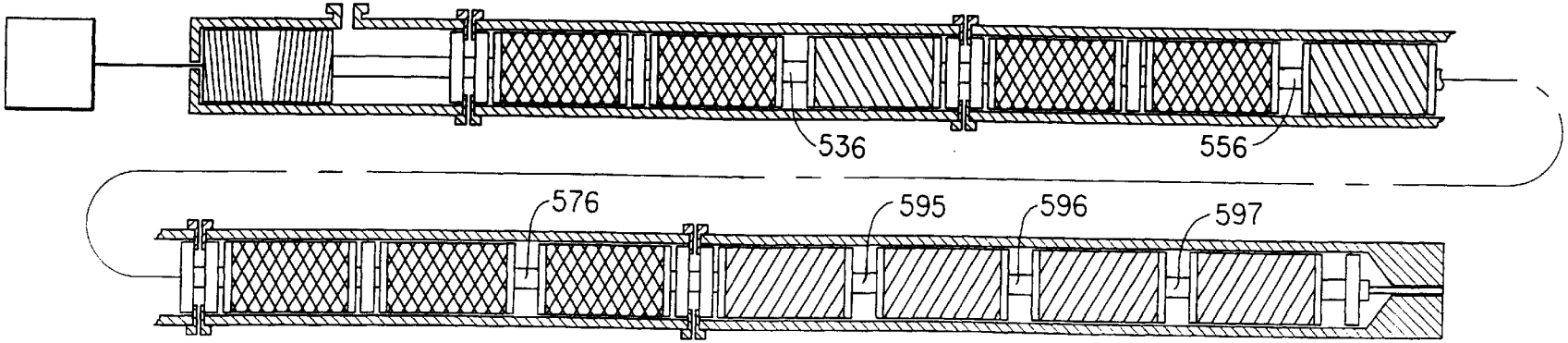
FIG. 4 is a detailed cross sectional view similar to FIG. 3 of a second preferred embodiment of the mechanical mixer.

Referring now to FIGS. 3 and 4, two preferred embodiments of the mechanical mixer 140 are illustrated in greater detail. Focusing on the first preferred embodiment illustrated in FIG. 3, the mechanical mixer 140 comprises a long, generally cylindrical chamber 200 with a drive shaft 205 running generally along the axis thereof. The drive shaft 205 is connected to a suitable drive motor 208 positioned at the left end of the chamber 200. The chamber includes a polymer inlet 210 wherein the molten polymer is directed from the extruder 120 via the gear pump 130 (shown in FIG. 2).

A threaded seal portion 211 between the polymer inlet and the drive motor 208 is arranged to form a seal at the first end of the chamber 200 using the molten polymer. The threaded seal portion 211 includes two sets of counter oriented threads arranged closely spaced from the inner wall of the chamber 200. The two sets of counter oriented threads are each oriented to push polymer toward the other set of threads. Thus, during operation, some of the thick molten polymer will move into the annular space between the inner wall of chamber 200 and the counter oriented threads of the threaded seal portion 200. The molten polymer in this annular space gets squeezed between the two sets of countered oriented threads and the proximate inner wall of the chamber 200 thereby sealing the remainder of the chamber 200 from the drive motor. The seal at the seal portion 211 is effective if it (1) maintains the pressure in the mechanical mixer at a level suitable for mixing spin agent and polymer, and (2) prevents leakage of all of the lower viscosity spin agent. As can be seen in the figures, the polymer inlet is positioned between the seal portion 211 and the first spin agent injection station 156 which help to keep the spin agent away from seal portion 200 and the interface between cylindrical chamber 200 and the rotating shaft 205.

Figure 5:
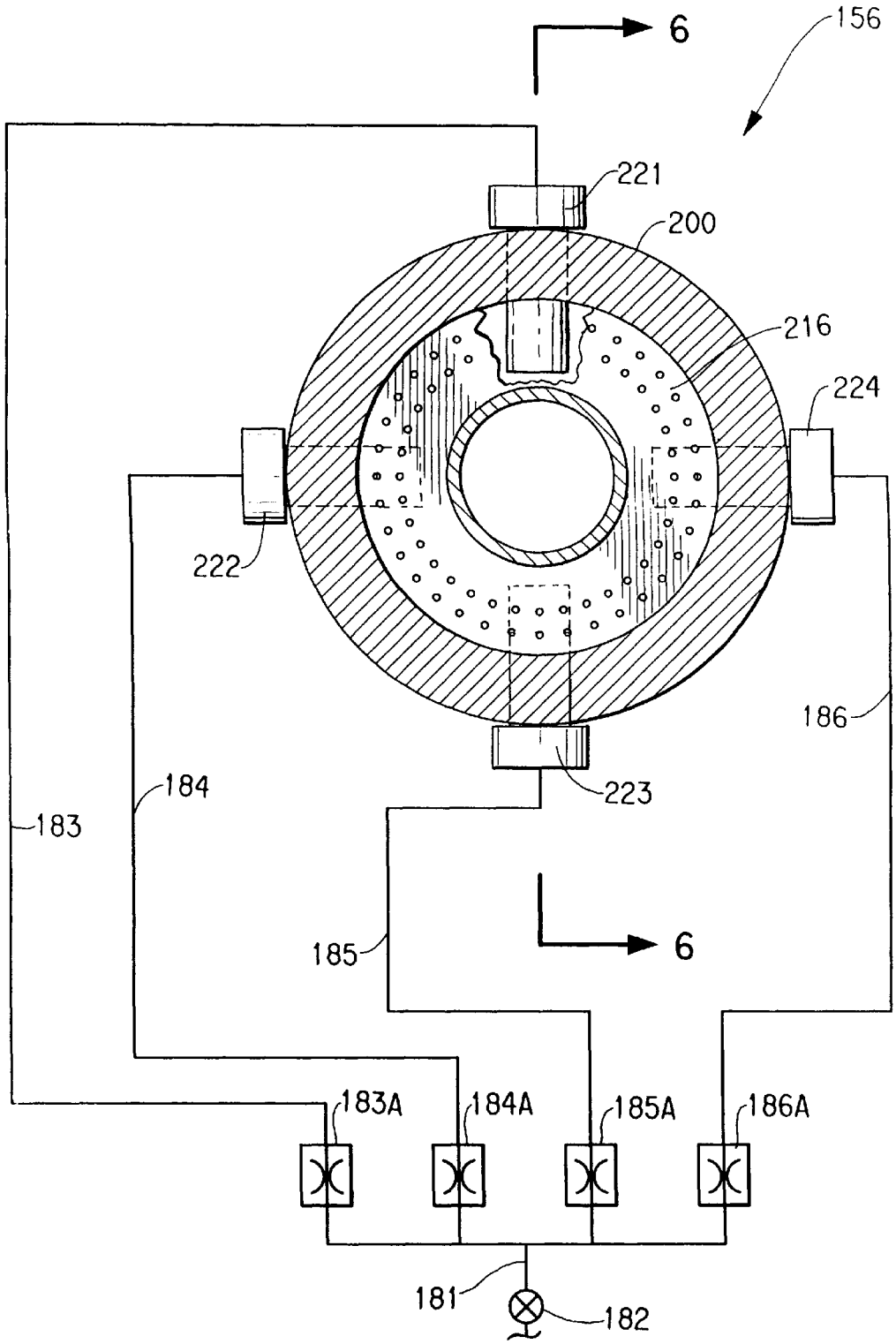
FIG. 5 is an enlarged detailed cross sectional view of a portion of the mechanical mixer taken along the line 5—5 in FIG. 3, particularly illustrating the improved arrangement for injecting spin agent into the mechanical mixer.
Figure 6:
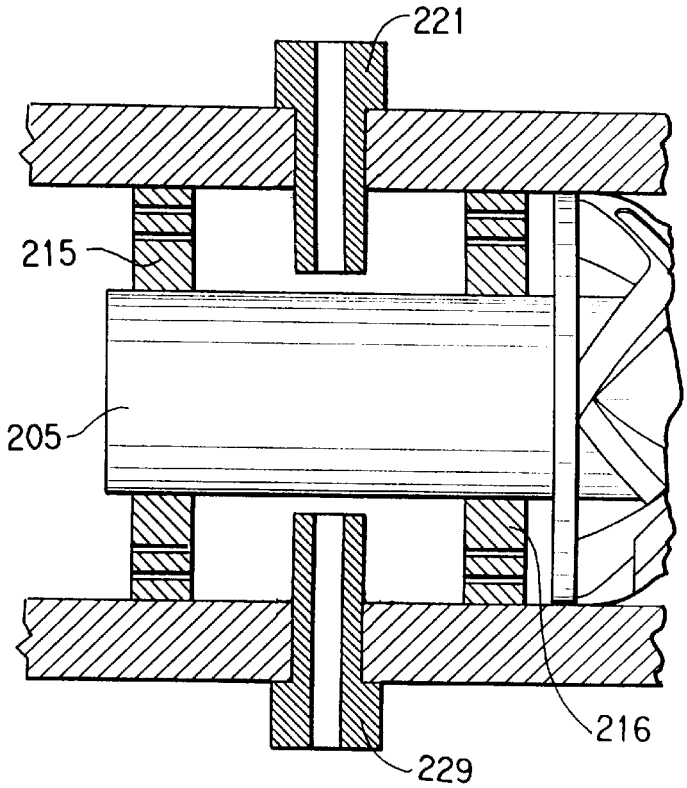
FIG. 6 is a cross sectional view of the spin agent injection arrangement taken along the line 6—6 in FIG. 5.

The polymer moves from the inlet 210 on through the chamber 200 along the rotating shaft 205 to the first spin agent injection station 156 where spin agent first contacts the molten polymer. The spin agent injection system 150 is best understood by reference particularly to FIGS. 5 and 6 and also to FIG. 3. The first spin agent injection station 156 includes first and second perforated injector plates 215 and 216 mounted to the drive shaft 205. Each of the injector plates 215 and 216 include a plurality of holes through which the polymer mass is directed and divided into a plurality of flows creating substantial boundary areas for the spin agent to contact the polymer. Between the two injector plates are a plurality of injector nozzles 221, 222, 223, and 224 which are spaced about the periphery of the chamber 200. Thus, the spin agent is well distributed about the annular space between the shaft 205 and the inner wall of the chamber 200.

Focusing now on the portion of the spin agent injection system 150 which carries the spin agent to the individual injectors 221, 222, 223 and 224, the first spin agent injection station 156 is supplied with spin agent through a common feed line 181. The feed line 181 includes a metering valve 182 which, in conjunction with similar metering valves at the other injection stations regulates the portion of spin agent that is injected at each station. The feed line directs the spin agent into each of four nozzle lines 183, 184, 185 and 186 leading to each of the four injector nozzles 221, 222, 223, and 224. Each of the respective nozzle lines includes a restrictor valve 183A, 184A, 185A, and 186A which effectively creates a generally uniform predetermined flow for a given pressure drop through each of the nozzle lines. The restrictor valves enable the injection system 150 to clear a clogged injector nozzle by applying a high pressure to the clogged nozzle to clear the clog. As a nozzle clogs, the flow through the line decreases which in turn reduces the pressure drop at the corresponding restrictor valve. The pressure increases behind the clog until the clog is pushed out into the chamber 200. It should be noted that restrictor valves may alternatively be replaced by orifice plates or capillaries or the like.

The second and third spin agent injection stations 157 and 158 are similar to the first spin agent injection station 156 and each include four injection nozzles with corresponding restrictor valves. Thus, detailed drawings of the second and third injection stations are not believed necessary for explanation thereof. However, the spin agent injection stations may be arranged in an alternative arrangement as illustrated in FIG. 7.

Figure 7:
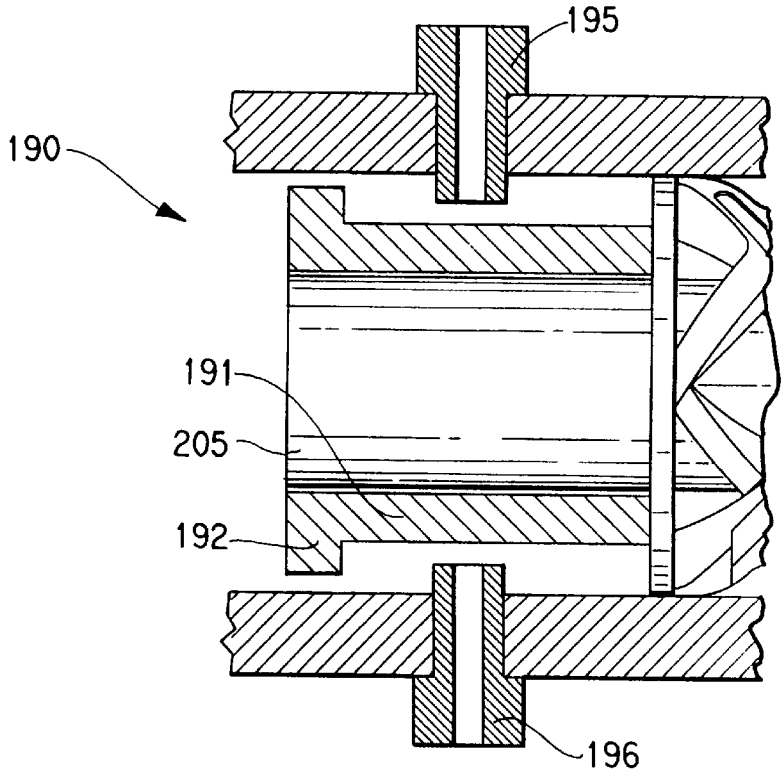
FIG. 7 is cross sectional view similar to FIG. 6 illustrating an alternative embodiment of the injection arrangement.

The second alternative embodiment of an injection station shown in FIG. 7 is generally indicated by the number 190 and includes a single sleeve 191 overlying the shaft 205 rather than the pair of perforated injector plates. The sleeve includes a radial flange 192 at the upstream end thereof to create an area of smaller annular space between the radial flange 192 and the inner wall of the chamber 200, followed by an area of larger annular space. Thus, as the polymer moves through the mechanical mixer 140, it is accelerated in vicinity of the injector nozzles 195 and 196 as the polymer passes through the reduced annular space between the sleeve 191 and the inner wall of chamber 200. It is noted that the second injection station embodiment would include injector nozzles which are essentially the same as the injector nozzles of the first embodiment of FIG. 6.

Referring back to the movement of the molten polymer through the mechanical mixer 140, the polymer now having a first dose of spin agent is mixed or dispersed by mechanical agitation or shearing forces generated by a series of mixing elements attached to the shaft 205. In the preferred embodiment shown in FIG. 3, the mechanical mixer 140 includes four groupings of mixing elements wherein the first grouping includes three mixing elements 231, 232 and 233. As will be described in more detail below, the first two mixing elements 231 and 232 of the first grouping are duplicates of one another while the third mixing element 233 is a differently styled mixing element. The mixing elements 231, 232 and 233 are preferably designed as interchangeable sections such that the various sections can be switched and replaced to enable the creation of a wide variety of different styled mixers. This has the advantage of providing greater flexibility in design without adding tremendously to the cost.

Figure 8:
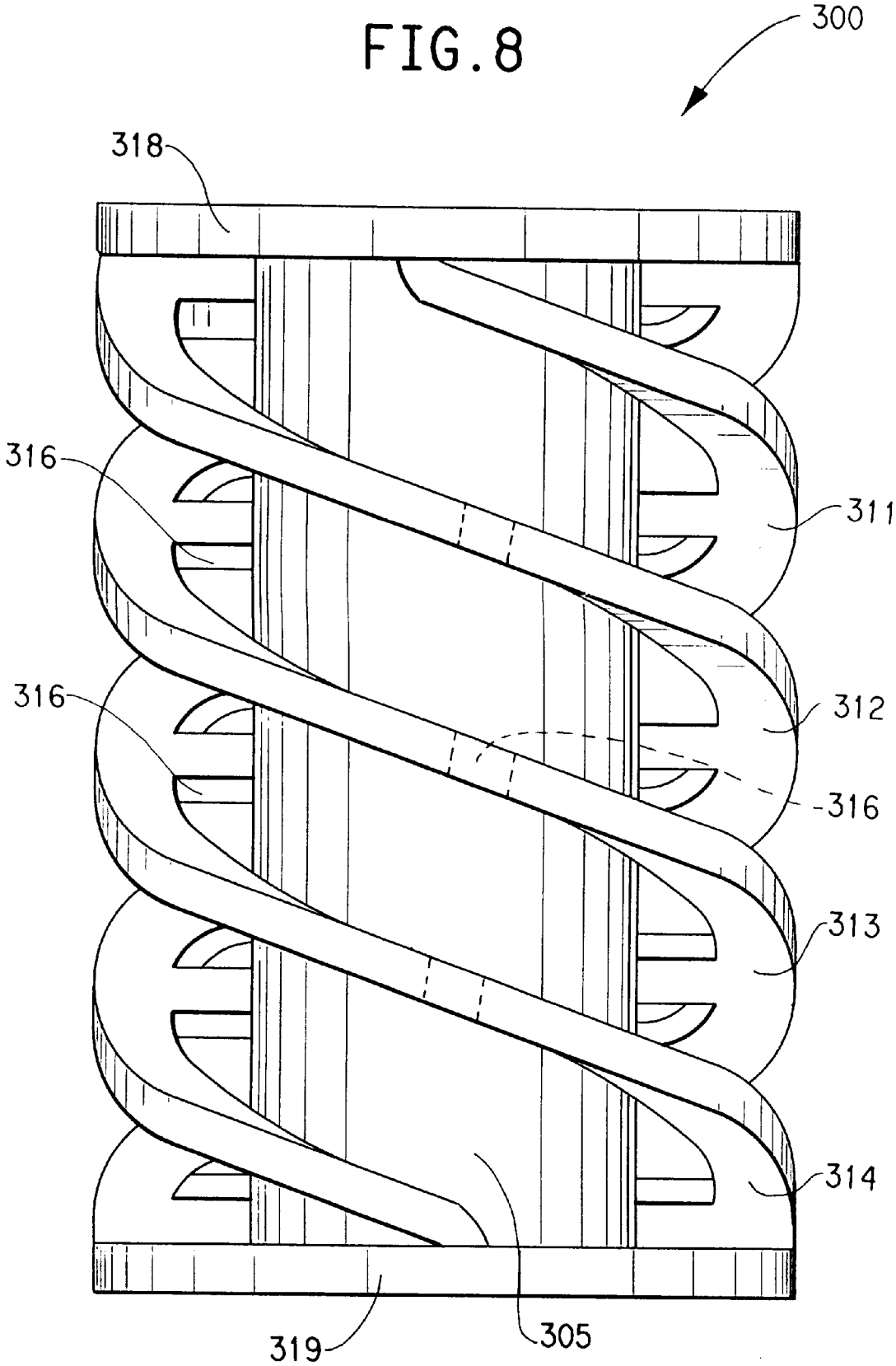
FIG. 8 is an elevational view of a single mixer section from the mechanical mixer.

Focusing now on the details of the particular mixing sections, a forward helical mixing element (generally indicated by the number 300) is illustrated in FIG. 8. For purposes of clarity, three differently styled mixing "elements" will be described which may be arranged in various combinations on the shaft 205. The forward helical mixing element 300 comprises a hollow core shaft 305 adapted to be slipped onto the main mixer shaft 205 A suitable arrangement may be provided to lock the hollow core shaft 305 to the drive shaft 205 such as a conventional key way or by pins, etc. The mixing section 300 further includes a series of helical flights 311, 312, 313, and 314 set out and away from the hollow core shaft 305 and having an outer radius slightly smaller than the radius of the inner wall of the chamber 200. The helical flights are fixed to the hollow core shaft by a plurality of radiating flight support legs 316. The flight support legs 316 are preferably welded onto the hollow core shaft but may alternatively be attached by screw thread or other suitable arrangement. The ends of the helical flights are adapted to terminate into end rings 318 and 319 which are also spaced from the core shaft 305. In the preferred embodiment there are four helical flights, each offset by 90 degrees to the adjacent flights which is particularly easy to see when considering where the helical flights intersect the end rings 318 and 319. The preferred embodiment is arranged such that the length of the mixing section 300 is approximately twice the diameter of the periphery of the helical flights and each flight makes one complete revolution around the core shaft 305 in a ribbon-like manner. It should be noted that the forward helical mixing element 300 includes a space between the exterior of the hollow core shaft and the inner portions of both the helical flights and the end rings.

In the preferred embodiment, the forward helical mixing element 300 rotates such that the polymer is pushed forward in the mechanical mixer 140. As such, the illustrated mixing element 300 is characterized as a forward helix mixing section. A reverse helical type mixing element is configured essentially the same as a forward helical mixing element except that the flights are oriented to push the polymer in the opposite direction.

During development of the mechanical mixer 140, a mechanical mixer was tested in which all of the mixing elements were either forward helical mixing elements or reverse helical mixing elements. With such a mechanical mixer, difficulties relating to slow spin agent absorption rates and great differences in viscosity between the polymer and spin agent became most pronounced. It was found that the forward helical mixing element 300 did little to disperse spin agent into the polymer and, in some tests, appeared to substantially retard mixing. The observed action was that the heavier thicker polymer was being conveyed forward in the mechanical mixer 140 by the helical blades 311, 312, 313 and 314 while the spin agent was being expressed from the mass and actually backing up in the chamber along the hollow core shaft 305. As a result, the polymer was pushed through the mechanical mixer 140 without absorbing the predetermined amount of spin agent suitable for flash spinning. This separation process is referred to herein as differential conveying. Where differential conveying exists, the thicker, more viscous fluid in the mixer is conveyed at a different speed or even in a direction opposite from the lighter less viscous fluid. It should be understood that differential conveying applies to the polymer and spin agent while they are still dispersed and not to the homogeneous solution once it is formed.

On the other hand, a reverse helical mixing element was better at dispersing the spin agent and polymer so as to enhance absorption. However, the reverse helical mixing element opposes the forward progress of the solution through the chamber 200. This resistance creates a substantial pressure drop in the solution. As noted above, the cloud point of the solution, particularly in the initial high viscosity zones, is at a relatively high pressure. Thus, any substantial pressure drop risks bringing the pressure of the solution to a level which risks counteracting the effects of the mixing. Once the pressure of the solution falls to the cloud point, the spin agent and polymer that has already formed a homogeneous solution will separate. Thus, although satisfactory mixing may be achieved with a reverse helical mixing element, the solutioning system can only tolerate a certain amount of pressure drop.

Figure 9:
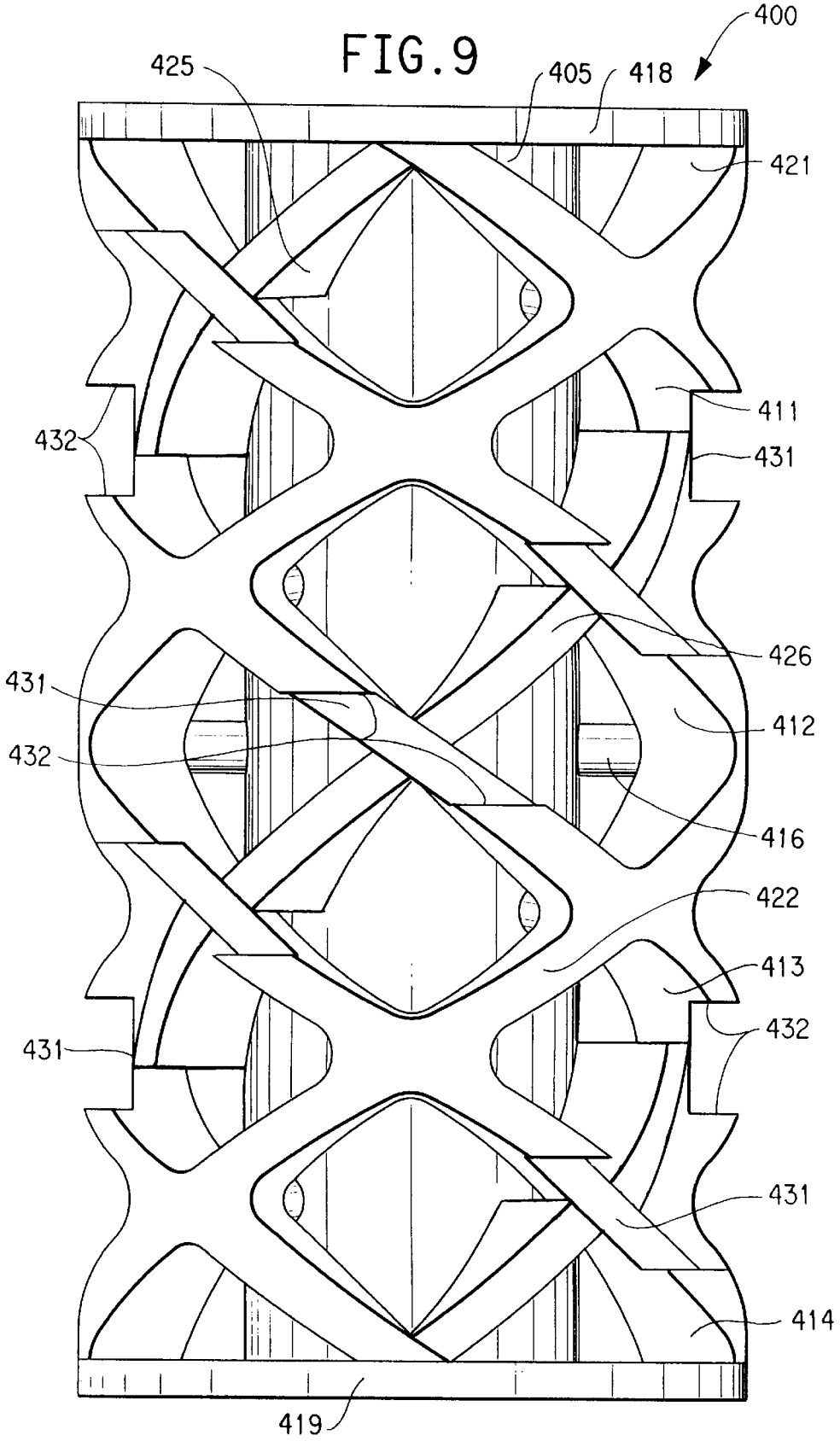
FIG. 9 is an elevational view of a second mixer section from the mechanical mixer.

Referring now to FIG. 9, there is illustrated a counterhelix mixing element 400 which has been found to generate the desired dispersion without creating differential conveying or excessive pressure drop. The counterhelix mixing element 400, comprises a hollow core shaft 405, flight support legs 416 and end rings 418 and 419. The counterhelix mixing element 400, similar to the forward helical mixing element 300, also includes four helical blades 411, 412, 413 and 414 which are spaced from the hollow core shaft 405.

As can be more clearly seen in the drawing, the counterhelix mixing element 400 includes additional structure not found in the forward helical mixing element 300. In particular, two peripheral reverse oriented helical blades 421 and 422 are interlaced through the forward oriented helical blades 411, 412, 413 and 414. The reverse oriented helical blades are, like the forward oriented helical blades, each spaced from the hollow core shaft 405. The mixing element 400 further includes two additional reverse oriented helical blades called shaft mounted helical blades 425 and 426 which are positioned effectively between the reverse peripheral helical blades 421 and 422 but are mounted directly onto the hollow core shaft 405. The shaft mounted reverse oriented helical blades 425 and 426 extend radially outwardly slightly more than half the distance from the hollow shaft to the inner wall of the chamber 200. The radial projection of the shaft mounted helical blade is also greater than the spacing of the peripherally mounted forward and reverse helical blades 411, 412, 413, 414, 421 and 422 from the core shaft 405. The shaft mounted reverse oriented helical blades 425 and 426 are also segmented, or not continuous, having breaks corresponding to about every other intersection with a forward oriented helical blade. The peripheral mounted forward and reverse oriented blades 411, 412, 413, 414, 421 and 422 are all continuous and where they intersect are welded or otherwise configured to meld together.

One aspect to note is that the shaft mounted helical blades 425 and 426 limit the availability of a direct flow path along the hollow core shaft 405. In this manner, differential conveying is thus reduced by creating a rather tortuous path through the mixing element 400. Without wishing to be limited by theory, it is believed that the greatest amount of shearing that causes the mixing of the polymer and spin agent is at the peripheral edges of the helical blades adjacent the inner wall of the chamber 200. It is further believed that the shaft mounted helical blades 425 and 426 prevent the polymer solution from bypassing or avoiding the most productive portions of the mixer where the greatest amount of shearing is generated.

A further structural feature of the counterhelix mixing element 400 is that the forward oriented peripheral blades include peripheral notches 431 cut therein to relieve pressure at the inner wall of the chamber 200. The sizes of the notches are preferably cut such that the respective opposite notch faces 432 do not overlap in the longitudinal direction. In other words, a line may be drawn parallel to the axis of the hollow shaft core 405 that extends through the notch 431 without intersecting either of the opposite notch faces 432. Preferably, the notches are arranged on the forward oriented blades 411, 412, 413, and 414 in a manner such that the notched portion of each blade is followed by a solid portion on the next blade as the mixing element 400 rotates. With this arrangement, matter that passes through any notch will be impacted by the next one of the forward oriented rotating blades and polymer, spin agent and solution are not allowed to build up on the inner wall of chamber 200.

With all these features and structural elements, the counterhelix mixing element 400 has been found empirically not to differentially convey fluids of different viscosity. This is also accomplished by the design of the mixing element 400 that does not impart any forward motion or reverse motion on the fluid in the chamber 200. Solution passing through the counterhelix mixing element 400 experiences the same pressure drop regardless of whether the element is rotating and regardless of the rotational speed. While it is known that the design described above achieves the objective of mixing fluids of very different viscosities without significant differential conveying of the fluids being mixed, the ranges of the parameters have not yet been extensively explored. Clearly, the potential parameters and variability of the parameters are considerable. Suffice it to note that the counterhelix mixing element of the present invention creates substantial dispersion of the fluids such that the fluids have the opportunity for ready absorption while substantially not rendering effects that have the strong consequence of undoing the intended object.

Returning again to FIG. 3 to continue the description of the first preferred embodiment of the mechanical mixer 140, the first mixing element 231 comprises a counterhelix mixing element 400. The second mixing element 232 also comprises a counterhelix mixing element 400. Between the first and second mixing elements 231 and 232 is a first intervening perforated plate 235 which is essentially of the same construction as the perforated injection plates 215 and 216. The intervening perforated plate 235 provides substantial shear on the mass of polymer and spin agent to hasten the absorption of the free spin agent therein.

It is believed that the polymer and spin agent are well dispersed by the time they pass through the end of the second mixing section and that further dispersion is unnecessary. Thus, the third mixing element 233 is a forward helical mixing element 300 so as to reduce the amount of further pressure drop in the solutioning system 100. As noted above, the forward oriented helical mixing elements 300 are believed to not necessarily render good mixing and in some circumstances tend to separate the fluids. However, once the spin agent is thoroughly mixed with the polymer, and the temperature and pressure are above the cloud point, a stable solution is formed and a forward helical mixing element 300 is not going to separate the spin agent from the polymer unless the pressure falls below the cloud point. Between the third mixing element 233 and the second mixing element is a second intervening perforated plate 236 similar to the first perforated plate 235.

The first preferred embodiment of the mechanical mixer 140 further includes a second grouping of three mixing elements 251, 252 and 253 which follows the second injection station 157. The second grouping is very similar to the first. The fourth and fifth mixing elements 251 and 252 are counterhelix mixing elements 400. The sixth mixing element 253 is a forward oriented helical mixing element 300. Third and fourth intervening perforated plates 255 and 256 are positioned between the fourth, fifth and sixth mixing elements 251, 252 and 253.

The mechanical mixer further includes a third grouping of three mixing elements 271, 272 and 273 which follow the third injection station 158. In this third grouping, the seventh, eighth and ninth mixing elements 271, 272 and 273 are all counterhelix mixing elements 400 with intervening perforated plates 275 and 276 positioned thereinbetween. The preferred embodiment includes one further injection station 159 for flexibility of design; however, it is closed off and not used at present. The fourth and last injection station provides demarcation between the third grouping and the last grouping of mixing elements. The mechanical mixer 140 includes a final grouping of mixing elements, this last grouping includes four mixing elements 291, 292, 293, and 294. The mixing elements of the last group are reverse helical mixing elements as described above. The reverse helical mixing elements are essentially constructed the same as the forward helical mixing element 300 except the flights are oriented in the opposite direction to push the fluid backwards in the mechanical mixer 140. The reverse oriented helical elements tend to provide good mixing. The mixing elements 291, 292, 293, and 294 provide some final mixing before the solution is discharged to the static mixer system 160. Intervening perforated plates 295, 296 and 297 are positioned between the elements as in the previous groupings. A discharge plate 298 is arranged at the end of the shaft 205 to center the same. Once the polymer passes the discharge plate, it is discharged through outlet 299.

Referring to FIG. 4, a second preferred embodiment of the mechanical mixer 140 is shown which is quite similar to the embodiment shown in FIG. 3 . Thus, for purposes of brevity, the discussion will be limited to the differences between the first and second preferred embodiments. Corresponding components in FIG. 4 are indicated with similar reference numbers except that the hundredths place includes a "5" rather than a "2". Referring to FIG. 4, the second intervening plate is replaced with a spacer 536. By eliminating the perforated plate, some of the pressure drop through the mechanical mixer 140 is reduced. Similarly the fourth, sixth, eighth, ninth and tenth perforated plates are substituted with spacers in the embodiment of the invention shown in FIG. 4. The mechanical mixer of the second preferred embodiment should result in less pressure drop and slightly less mixing than the first mixer embodiment of FIG. 3. The number of perforated plates may be adjusted if more or less thorough mixing is necessary to provide a solution suitable for flash spinning.

It should be noted that some of the perforated plates used in the mechanical mixer 140 may have different sizes of perforations and different numbers of openings. Generally, the larger size perforations are used at the first end of the mixer where the polymer has a higher viscosity. Plates having a larger number of smaller perforations are typically used later in the mixer 140 where the viscosity of the solution is lower and it is desired to be sure that all the spin agent is adsorbed into the polymer.

The foregoing description and drawings were intended to explain and describe the invention so as to contribute to the public base of knowledge. In exchange for this contribution of knowledge and understanding, exclusive rights are sought and should be respected. The scope of such exclusive rights should not be limited or narrowed in any way by the particular details and preferred arrangements that may have been shown. Clearly, the scope of any patent rights granted on this application should be measured and determined by the claims that follow.

We claim:

1. A mixer apparatus for mixing at least two fluid materials wherein at least two of the fluid materials have substantially different viscosities, the mixer apparatus comprising:

a generally cylindrical elongate tube forming an outer shell and defined by a longitudinal axis and an inner wall spaced at a generally uniform distance from the axis;

a rotatable shaft arranged along the longitudinal axis having a plurality of flights attached thereto;

the flights being arranged to provide substantial shear forces on the fluid mixture while generally not differentially conveying the two fluid materials which have a viscosity ratio of more than 10,000 to 1, and wherein the apparatus is divided into a plurality of mixer sections and wherein each mixer section is spaced from adjacent mixer sections by one of the group consisting of a free flow area for a polymer and spin agent and a plate having a plurality of holes through the thickness thereof to divide the polymer and spin agent into a number of finely divided streams, and further including a plurality of injection sites along the length of the tube and wherein each injection site includes disks having a plurality of holes extending therethrough positioned immediately upstream and immediately downstream from each of said injection sites.

2. The apparatus according to claim 1, further including helical flights on at least a portion of the shaft, and wherein a first helical flight is spaced from the shaft and a second helical flight is mounted to the exterior of the shaft and recessed away from the inner wall.

3. The apparatus according to claim 2, wherein one of the helical flights is segmented.

4. The apparatus according to claim 3, wherein at least one of the helical flights includes notches along the periphery of the blade.

5. The apparatus according to claim 4, wherein one of the helical flights conveys fluid along the housing in one direction and other of the helical flights conveys fluid in the other direction.

6. The apparatus according to claim 5, wherein said tube includes a polymer inlet near one end thereof and a solution outlet near the other end thereof, and wherein said second helical flight conveys fluids toward the polymer inlet of the tube, and wherein the first helical flight comprises at least one set of flights which conveys fluid toward the solution outlet and at least a second set of flights which convey fluids toward the polymer inlet.

7. A solutioning system for mixing a polymer and a spin agent wherein the spin agent and polymer are not readily miscible, the solutioning system forms a high pressure and temperature spin solution suitable for spinning plexifilaments, the solutioning system comprising:

a heating mechanism for melting the polymer;

a pressure creating device for raising the pressure of the molten polymer;

a mechanical mixer having a longitudinal generally cylindrical housing having an inner wall and a shaft mounted for rotation in said housing, wherein flights are arranged on said shaft to provide shear forces on the polymer and spin agent within the chamber while not causing differential conveying of the material in the housing, the solutioning system further comprising a spin agent injection system for injecting a portion of the spin agent into the molten polymer in the mechanical mixer and for adding further spin agent after the mechanical mixer, and wherein the solutioning system further comprises a static mixer for further mixing the polymer and spin agent to form a homogeneous solution.

8. The solutioning system according to claim 7, wherein the injection system includes a plurality of injection sites in the housing of the mechanical mixer along the length thereof.

9. The solutioning system according to claim 8, wherein the injection system a plurality of injectors at each injection site, and further wherein the injection system includes a restrictor system to clear clogs from injectors.

10. The solutioning system according to claim 7, wherein the mechanical mixer includes helical flights on at least a portion of the shaft, and wherein a first helical flight is spaced from the shaft and a second helical flight is mounted to the exterior of the shaft and recessed away from the inner wall.

11. The solutioning system according to claim 10, wherein at least one of the helical flights is segmented.

12. The solutioning system according to claim 10, wherein at least one of the helical flights includes notches along the periphery of the blade.

13. The solutioning system according to claim 10, wherein one of the helical flights conveys fluid along the housing in one direction and other of the helical flights conveys fluid in the other direction.

14. The solutioning system according to claim 13, wherein said housing of said mechanical mixer includes a polymer inlet near one end thereof and a solution outlet near the other end thereof, and wherein said second helical flight conveys fluids toward the polymer inlet of the housing, and wherein the first helical flight comprises at least one set of flights which conveys fluid toward the solution outlet and at least a second set of flights which convey fluids toward the polymer inlet.

15. The solutioning system according to claim 14, wherein at least a portion of said second set of flights includes notches along the periphery thereof.

16. The solutioning system according to claim 15, wherein the shaft includes hollow mixer sections mounted thereto so as to comprise a series of replaceable and alterable mixer sections.

17. The solutioning system according to claim 7, wherein the shaft includes hollow mixer sections mounted thereto so as to comprise a series of replaceable mixer sections.

18. The solutioning system according to claim 17, wherein at least one disc having a plurality of holes extending through the thickness thereof is positioned on the shaft between two adjacent mixer sections to divide the flow of polymer and spin agent into numerous strands.

19. The solutioning system according to claim 18, wherein the injection site is between two spaced apart discs, wherein each disc has a plurality of holes extending through the thickness thereof.

20. The solutioning system according to claim 7, further comprising a static mixing section for further mixing the polymer and spin agent after the mechanical mixer.

21. The solutioning system according to claim 20, wherein the static mixing section further includes at least two mixing zones with a relaxation zone between said mixing zone.

* * * * *